US008712295B2

(12) United States Patent
Itabashi

(10) Patent No.: US 8,712,295 B2
(45) Date of Patent: Apr. 29, 2014

(54) DEVELOPING DEVICE

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 243 days.

(21) Appl. No.: 13/197,884

(22) Filed: Aug. 4, 2011

(65) Prior Publication Data

US 2012/0057905 A1 Mar. 8, 2012

(30) Foreign Application Priority Data

Sep. 7, 2010 (JP) ..... 2010-200189

(51) Int. Cl.
*G03G 15/08* (2006.01)

(52) U.S. Cl.
USPC ..... 399/258; 399/106; 399/262

(58) Field of Classification Search
USPC ..... 399/106, 258, 262
See application file for complete search history.

(56) References Cited

U.S. PATENT DOCUMENTS

| | | | | |
|---|---|---|---|---|
| 5,608,501 | A | 3/1997 | Makino | |
| 6,185,401 | B1 | 2/2001 | Kanamori et al. | |
| 7,020,404 | B2 | 3/2006 | Fukuda et al. | |
| 7,369,798 | B2 | 5/2008 | Sasae et al. | |
| 7,522,851 | B2 * | 4/2009 | Koyama et al. | 399/27 |
| 7,738,817 | B2 | 6/2010 | Sasae et al. | |
| 7,783,234 | B2 | 8/2010 | Okamoto et al. | |
| 2004/0042816 | A1 | 3/2004 | Fukuda et al. | |
| 2006/0104673 | A1 | 5/2006 | Sasae et al. | |
| 2008/0124105 | A1 | 5/2008 | Okamoto et al. | |
| 2008/0260422 | A1 | 10/2008 | Sasae et al. | |

FOREIGN PATENT DOCUMENTS

| | | | |
|---|---|---|---|
| JP | 06-035313 | A | 2/1994 |
| JP | 07-225514 | | 8/1995 |
| JP | 2000-089645 | A | 3/2000 |
| JP | 2002-072681 | A | 3/2002 |
| JP | 2003-107892 | A | 4/2003 |
| JP | 2004-138776 | A | 5/2004 |
| JP | 2006-139069 | A | 6/2006 |
| JP | 2006-139070 | A | 6/2006 |
| JP | 2006-208532 | | 8/2006 |
| JP | 2007-033783 | A | 2/2007 |
| JP | 2008-015107 | A | 1/2008 |
| JP | 2008-164151 | A | 7/2008 |
| JP | 2009080477 | A | 4/2009 |

OTHER PUBLICATIONS

Office Action for Japanese patent application No. 2010-200189 mailed Sep. 11, 2012.

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A developing device includes: a developing unit; a toner cartridge; a shutter drive member; and a second gear. The toner cartridge is mountable on or detachable from the developing unit and includes a casing defining an internal space for accommodating a developing agent and formed with a communication hole for supplying the developing agent to the developing unit, and a shutter movable between an open position in which the communication hole is open and a closed position in which the communication hole is closed. The shutter drive member includes a first gear that extends in the moving direction of the shutter. The shutter drive member is engageable with the shutter to be movable together with the shutter when the toner cartridge is mounted on the developing unit. The second gear is meshingly engageable with the first gear to transmit a drive force to the first gear. The first gear is disengaged from the second gear when the shutter is in at least one of the open position and the closed position.

11 Claims, 13 Drawing Sheets

DEVELOPING DEVICE

CROSS REFERENCE TO RELATED APPLICATION

This application claims priority from Japanese Patent Application No. 2010-200189 filed Sep. 7, 2010. The entire content of the priority application is incorporated herein by reference.

TECHNICAL FIELD

The present invention relates to a developing device provided in an image forming device such as a color printer.

BACKGROUND

A conventional image forming device has a photosensitive drum and a developing device. The developing device has a casing on which a toner box for accommodating toner is mounted.

The toner box is formed in a shape having a circular circumferential surface, for example. The circular circumferential surface is formed with a toner discharge port for discharging toner toward an interior of the casing. The toner discharge port has a peripheral area provided with a seal member for preventing toner leakage. Further, a shutter is slidably movably provided at an outer periphery of the circular circumferential surface to open and close the toner discharge port.

After the toner box is mounted on the casing of the developing device, the shutter is slidingly moved to open the toner discharged port. As a result, a toner supply passage is defined between the toner box and the casing through the toner discharge port. Toner is supplied to the casing from the toner box via the toner supply passage.

In order to move the shutter to/from an open position in which the toner discharge port is open from/to a closed position in which the toner discharge port is closed, a gear provided at the shutter and a drive gear meshingly engageable with the gear are proposed. A drive force from the drive gear is transmitted to the gear for moving the shutter.

SUMMARY

However, with the above-described structure, undesirable rotation of the drive gear may occur, which lead to unintentional movement of the shutter to the closed position or the open position. Such an unintentional movement of the shutter to the closed position may block supply of toner from the toner box to the casing. When the shutter is unintentionally moved to the open position, toner leakage from the toner box may occur.

In view of the foregoing, it is an object of the present invention to provide a developing device capable of preventing a shutter from unintentionally moving from/to an open position to/from a closed position.

In order to attain the above and other objects, the present invention provides a developing device including: a developing unit; a toner cartridge; a shutter drive member; and a second gear. The toner cartridge is mountable on or detachable from the developing unit and includes a casing defining an internal space for accommodating a developing agent and formed with a communication hole for supplying the developing agent to the developing unit, and a shutter movable between an open position in which the communication hole is open and a closed position in which the communication hole is closed. The shutter drive member includes a first gear that extends in the moving direction of the shutter. The shutter drive member is engageable with the shutter to be movable together with the shutter when the toner cartridge is mounted on the developing unit. The second gear is meshingly engageable with the first gear to transmit a drive force to the first gear. The first gear is disengaged from the second gear when the shutter is in at least one of the open position and the closed position.

BRIEF DESCRIPTION OF THE DRAWINGS

The particular features and advantages of the present invention as well as other objects will become apparent from the following description taken in connection with the accompanying drawings, in which.

DETAILED DESCRIPTION

Next, a developing device according to one embodiment of the present invention will be described while referring to FIGS. 1 to 6D.

1. Structure of Color Printer

Figure 1:
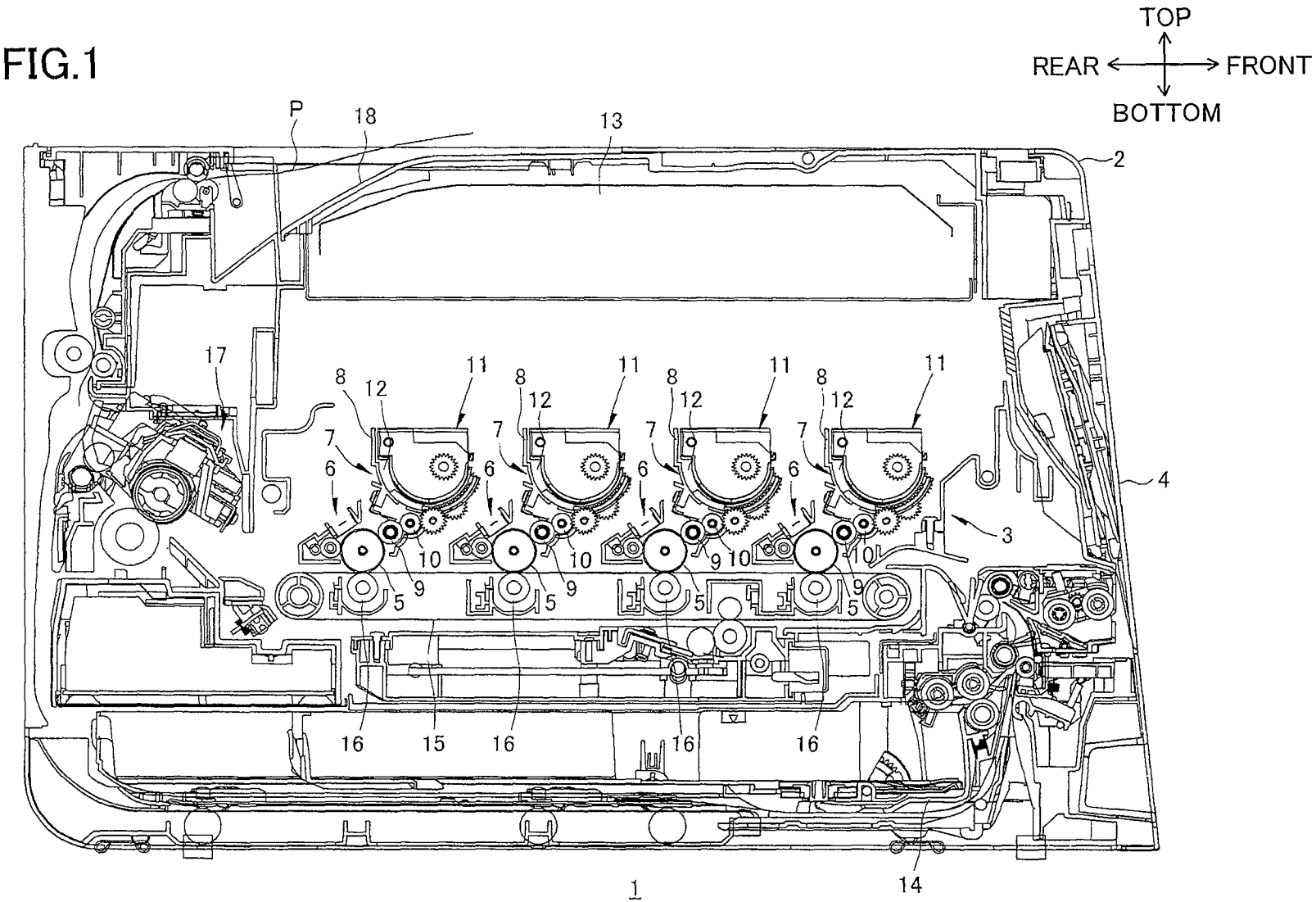
FIG. 1 is a cross-sectional view of a color printer provided with a developing device according to one embodiment of the present invention.
Figure 2:
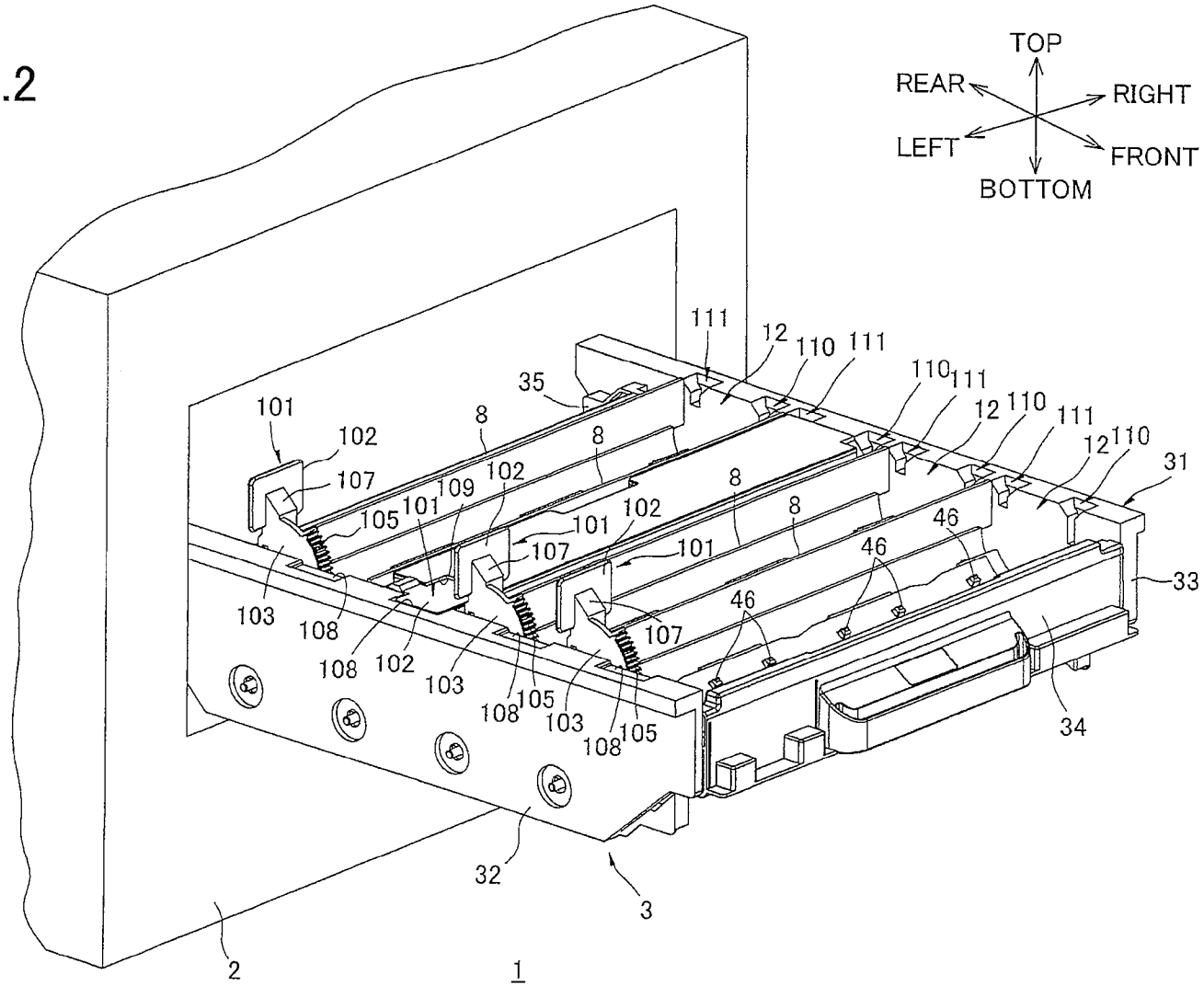
FIG. 2 is a perspective view of the color printer shown in FIG. 1, in which a drawer unit is located at a pulled-out position.

As shown in FIG. 1, an image forming device provided with the developing device according to the embodiment is a tandem-type color printer 1. As shown in FIGS. 1 and 2, the color printer 1 includes a main casing 2. A drawer unit 3 is mounted inside the main casing 2. The main casing 2 has a front portion at which a front cover 4 is provided. The front cover 4 is movable between an open position and a closed position. When the front cover 4 is in the open position, the drawer unit 3 can be moved horizontally between an accommodated position inside the main casing 2 (a position shown in FIG. 1) and a pulled-out position outside the main casing 2 (a position shown in FIG. 2).

The terms "upward", "downward", "upper", "lower", "above", "below", "right", "left", "front", "rear" and the like will be used throughout the description assuming that the color printer 1 is disposed in an orientation in which it is intended to be used. In the following description, a side of the color printer 1 on which the front cover 4 is provided (right side in FIG. 1) will be referred to as a front side of the color printer 1. Top, bottom, left, and right sides of the color printer 1 in the following description will be based on the reference point of a user viewing the color printer 1 from the front side. Directions related to the drawer unit 3 and a toner cartridge 11 that is mounted in the drawer unit 3 will be referred as if the drawer unit 3 and the toner cartridge 11 had been mounted in the main casing 2, unless otherwise specified. Note that the front cover 4 has been omitted from FIG. 2.

The drawer unit 3 includes a drawer frame 31 installing four photosensitive drums 5, four chargers 6, and four developing units 7.

As shown in FIG. 1, the four photosensitive drums 5 are rotatably retained in the drawer unit 3. The photosensitive drums 5 are rotatable about axes extending in a left-to-right direction. The four photosensitive drums 5 are respectively provided for the colors black, yellow, magenta, and cyan. The photosensitive drums 5 are arranged parallel to each other at regular intervals in a front-to-rear direction in the order black, yellow, magenta, and cyan from the front.

The four chargers 6 are also retained in the drawer unit 3. The chargers 6 have a one-on-one correspondence to the four photosensitive drums 5 and are disposed diagonally upward and rearward of the corresponding photosensitive drums 5. Each charger 6 is a Scorotron charger that includes a discharge wire and a grid, for example.

The four developing units 7 are also retained in the drawer unit 3. The four developing units 7 also have a one-on-one correspondence to the four photosensitive drums 5, and are disposed diagonally above and forward of the corresponding photosensitive drums 5.

Each developing unit 7 includes a developing unit frame 8 to which a developing roller 9 and a supply roller 10 are supported. The developing roller 9 is disposed so as to contact the corresponding photosensitive drum 5, and is rotatable about an axis extending in the left-to-right direction. The supply roller 10 is disposed diagonally above and forward of the developing roller 9 so as to contact the developing roller 9, and is rotatable about an axis extending in the left-to-right direction.

A space 12 is defined in the drawer unit 3 above each developing unit 7. The toner cartridge 11 for accommodating toner is mounted in the space 12. Sufficient free space above the drawer unit 3 is acquired for mounting the toner cartridges 11 in the spaces 12 by pulling the drawer unit 3 outward to the pulled-out position. The toner cartridges 11 supply toner to the corresponding developing units 7.

An exposure unit 13 is provided in the main casing 2 above the drawer unit 3. The exposure unit 13 is adapted to irradiate four laser beams corresponding to the four colors used by the color printer 1.

As each photosensitive drum 5 rotates, the corresponding charger 6 applies a uniform charge to the surface of the photosensitive drum 5. Subsequently, the exposure unit 13 irradiates laser beams for selectively exposing the surfaces of the photosensitive drums 5. This exposure selectively removes charge from the surfaces of the photosensitive drums 5, forming electrostatic latent images thereon. When the electrostatic latent image carried on the surface of the photosensitive drum 5 rotates to a position opposite the corresponding developing roller 9, the developing roller 9 supplies toner to the electrostatic latent image, thereby forming a toner image on the surface of the photosensitive drum 5.

Four LED arrays may be provided for the four photosensitive drums 5 in place of the exposure unit 13.

A sheet cassette 14 accommodating sheets of paper P is disposed at a bottom section of the main casing 2. Each sheet P accommodated in the sheet cassette 14 is conveyed onto a conveying belt 15 by various rollers. The conveying belt 15 confronts the four photosensitive drums 5 from below. Four transfer rollers 16 are disposed inside the conveying belt 15 at positions confronting the photosensitive drums 5 through an upper portion of the conveying belt 15. When the sheet P is conveyed onto the conveying belt 15, the conveying belt 15 carries the sheet P sequentially to positions between the conveying belt 15 and each of the photosensitive drums 5. As the sheet P passes beneath each photosensitive drum 5, the toner image carried on the surface of the photosensitive drum 5 is transferred onto the sheet P.

A fixing unit 17 is provided at a position downstream of the conveying belt 15 with respect to a direction that the sheet P is conveyed. After toner images are transferred onto the sheet P, the sheet P is conveyed to the fixing unit 17, where the toner images are fixed to the sheet P by heat and pressure. After the toner images have been fixed in the fixing unit 17, various rollers discharge the sheet P onto a discharge tray 18 provided on a top surface of the main casing 2.

2. Drawer Unit (1) Drawer Frame

As shown in FIG. 2, the drawer unit 3 has the drawer frame 31. The drawer frame 31 is configured of a pair of left and right side plates 32, 33 arranged parallel to each other and separated in the left-to-right direction, a front beam 34 bridging the front ends of the side plates 32 and 33, and a rear beam 35 bridging the rear ends of the side plates 32 and 33. The overall structure of the drawer frame 31 is square-shaped in a plan view.

The respective groups of four photosensitive drums 5, four chargers 6, and four developing units 7 (FIG. 1) are all held together between the side plates 32 and 33. The spaces 12 in which the toner cartridges 11 are mounted are defined between the side plates 32 and 33 above the corresponding developing units 7. In other words, the side plates 32 and 33 hold the photosensitive drums 5, the chargers 6, and the developing units 7. Further, the side plates 32 and 33 oppose each other in the left-to-right direction, with gaps formed therebetween to allocate the spaces 12 in which the toner cartridges 11 are mounted.

(2) Developing Unit Frame

Figure 3:
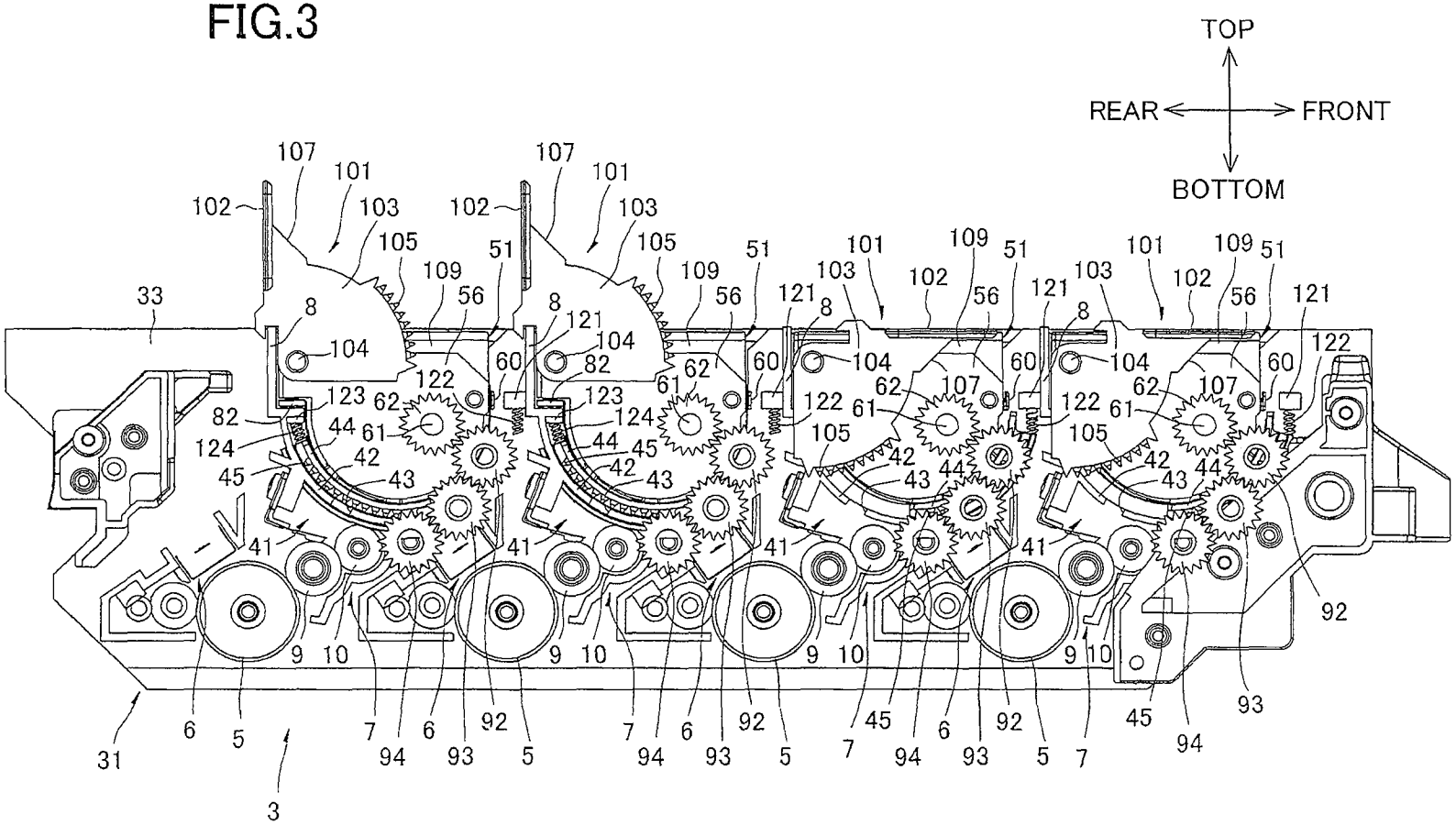
FIG. 3 is a cross-sectional view of the drawer unit shown in FIG. 2 as viewed from a left side and a left side view of four operation units, wherein all toner cartridges are mounted, and two of the four operation units from a rear side are in a first posture and remaining two of the four operation units are in a second posture.

As shown in FIGS. 2 and 3, the four developing unit frames 8 are disposed at regular intervals in the front-to-rear direction and span between the side plates 32 and 33. The developing unit frames 8 define the spaces 12 provided for mounting the toner cartridges 11.

As shown in FIG. 3, a developing chamber 41 is provided in each developing unit frame 8 for accommodating the developing roller 9. The developing chamber 41 has a lower open side opposing the corresponding photosensitive drum 5. The developing roller 9 is disposed in the bottom of the developing chamber 41 near the open side thereof.

The developing unit frame 8 also has a plate-shaped partitioning wall 42 positioned between the developing chamber 41 and the space 12 for mounting the toner cartridge 11. The partitioning wall 42 curves in an arc shape with its convex side facing the developing chamber 41. The partitioning wall 42 partitions the interior of the developing unit frame 8 into the developing chamber 41 and the space 12 formed above the developing chamber 41. Three rectangular openings 43 are formed in a circumferential center of the partitioning wall 42. The openings 43 are formed at positions opposing three cartridge communication holes 58 (FIG. 5) formed in the toner cartridge 11 when the toner cartridge 11 is mounted in the space 12.

Incidentally, FIG. 2 illustrates that only one of the toner cartridges 11 is mounted in the drawer unit 3. Remaining three of the toner cartridges 11 are omitted from FIG. 2.

(3) Shutter Drive Member

As shown in FIG. 3, a shutter drive member 44 is movably disposed above the partitioning wall 42 for driving a shutter 73 described later.

The shutter drive member 44 is formed into an arcuate plate shaped, with the convex side facing the developing chamber 41. The arcuate shape of the shutter drive member 44 substantially conforms to the shape of the partitioning wall 42. The shutter drive member 44 has a bottom surface provided with a rack gear 45. The shutter drive member 44 has a top surface provided with shutter drive protrusions 46 (FIG. 2) at positions corresponding to shutter drive openings 88 (FIG. 5) described later.

(4) Operation Unit

As shown in FIG. 2, four operation units 101 are provided at the left side plate 32 of the drawer unit 3 at positions corresponding to the spaces 12. Each of the operation units 101 includes a regulating member 102 having a rectangular plate shape, and a drive gear portion 103 having a generally sector shape with a centre angle of 90 degrees as viewed from a left side and connected to the regulating member 102. The regulating member 102 and the drive gear portion 103 are integrally formed. The operation unit 101 is shiftable between a first posture in which the regulating member 102 protrudes upward of the drawer frame 31 and extends vertically, and a second posture in which the regulating member 102 extends along a top surface of the drawer frame 31.

The operation unit 101 will be hereinafter described based on a situation that the operation unit 101 is in the first posture.

The sector-shaped drive gear portion 103 has one radial side, another radial side defining the center angle of 90 degrees in connection with the one radial side, and an arcuate portion between the one and the other radial sides. The one radial side extends vertically, and is connected to the regulating member 102. The other radial side extends horizontally. The arcuate portion of the sector-shaped drive gear portion 103 is formed so as to protrude forward and upward. As shown in FIG. 3, a pivot shaft 104 is provided at the drive gear portion 103 in the corner between the portion defined by the one radial side and the other radial side. The pivot shaft 104 extends through the drive gear portion 103 in the left-to-right direction so that the drive gear portion 103 is pivotally movable about the pivot shaft 104. The pivot shaft 104 has a left end portion which is fixedly supported to the left side plate 32. With this configuration, the operation unit 101 is supported to the left side plate 32 and pivotally movable about the pivot shaft 104. By pivotally moving about the pivot shaft 104, the operation unit 101 can be shifted between the first posture and the second posture.

A lower half of the arcuate portion of the sector-shaped drive gear portion 103 is formed with gear teeth 105.

Figure 4:
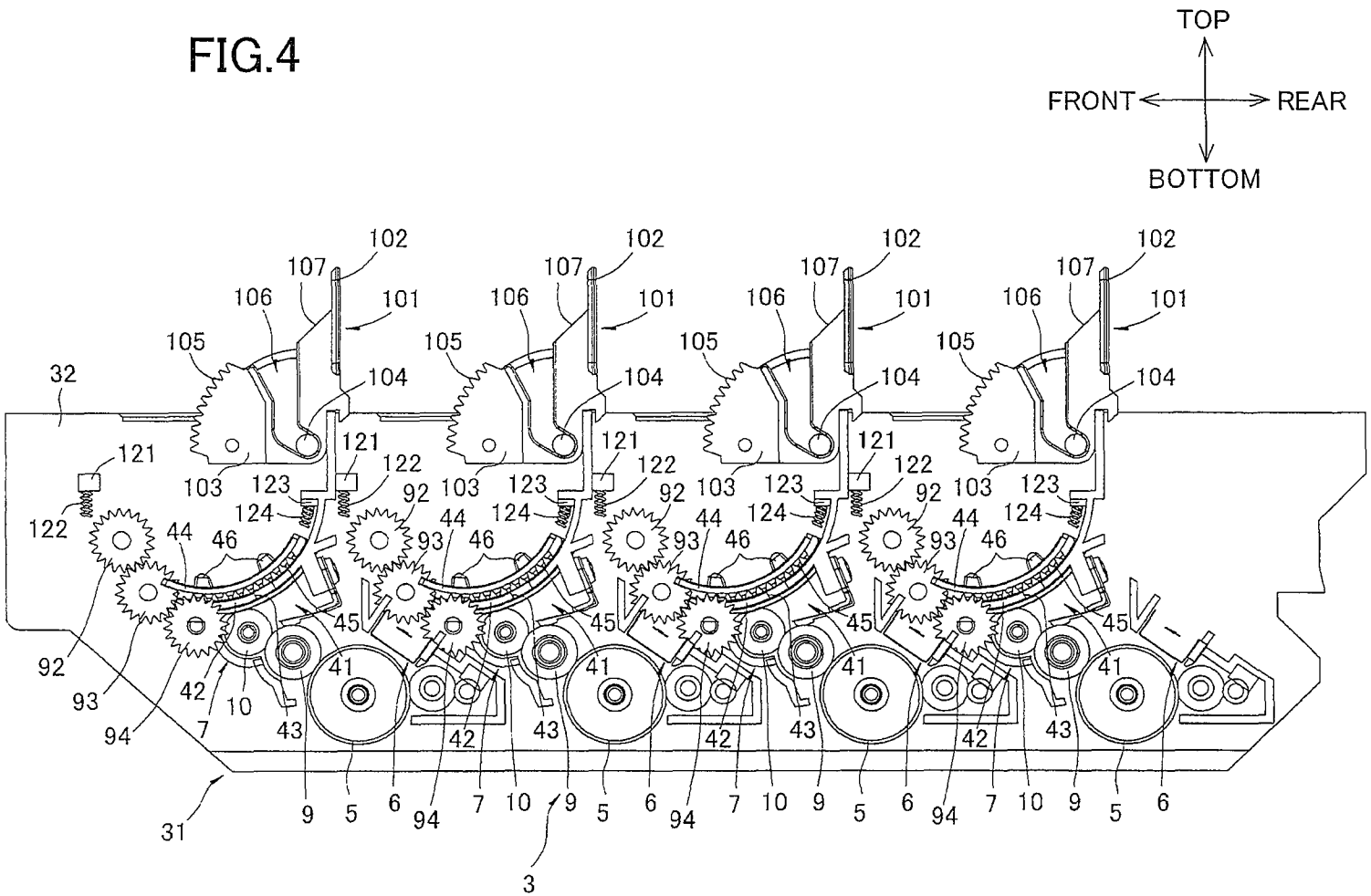
FIG. 4 is a cross-sectional view of the drawer unit shown in FIG. 2 as viewed from a right side, wherein all the toner cartridges are removed and all the operation units are in the first posture.

As shown in FIG. 4, the drive gear portion 103 has a right side surface formed with a guide groove 106. The guide groove 106 has an opening at an upper half of the arcuate portion of the sector-shaped drive gear portion 103, and extends downward from the opening and bends diagonally downward and rearward toward the pivot shaft 104. The drive gear portion 103 has a guide surface 107 defined between an upper edge (rear edge) of the guide groove 106 and a front surface of the regulating member 102. The guide surface 107 extends diagonally downward and frontward from the front surface of the regulating member 102.

(5) Supporting Mechanism

As shown in FIG. 2, the left side plate 32 has a top surface formed with four recessed portions 108 at positions corresponding to the regulating members 102. Each of the recessed portions 108 is formed in a square shape. The recessed portion 108 has a depth substantially equal to a thickness of the regulating member 102.

The toner cartridge 11 has a casing 51 (described later), and a top surface 52 of the casing 51 is formed with a recessed portion 109 at a position frontward of a left end thereof, as shown in FIG. 2. The recessed portion 109 is at a position corresponding to the regulating member 102 when the toner cartridge 11 is mounted in the space 12. The recessed portion 109 has a square shape whose left side and front side are open. When the operation unit 101 is in the second posture, the regulating member 102 is seatable on the recessed portion 108 of the left side plate 32 and the recessed portion 109 of the toner cartridge 11. More specifically, a lower surface of the regulating member 102 contacts the top surface of the left side plate 32 within the recessed portions 108, and an upper surface of the regulating members 102 is in flush with the top surface 52 of the casing 51 and the top surfaces of the side plates 32, 33.

The right side plate 33 has an inner surface (left surface) formed with a first supporting groove 110 and a second supporting groove 111 at positions corresponding to each space 12. That is, each of four sets of the first supporting groove 110 and the second supporting groove 111 is formed in the right side plate 33 at a position corresponding to each space 12. The first supporting groove 110 and the second supporting groove 111 are spaced apart from each other in the front-to-rear direction. Each of the first supporting groove 110 and the second supporting groove 111 extends vertically and open upward. Each of the first supporting groove 110 and the second supporting groove 111 has a top end portion having a width in the front-to-rear direction gradually increasing toward the top of the right side plate 33. That is, each of the first supporting groove 110 and the second supporting groove 111 is of a Y-shape as viewed from a left side. The first supporting groove 110 has a vertical length greater than that of the second supporting groove 111.

3. Toner Cartridge (1) Casing

Figure 5:
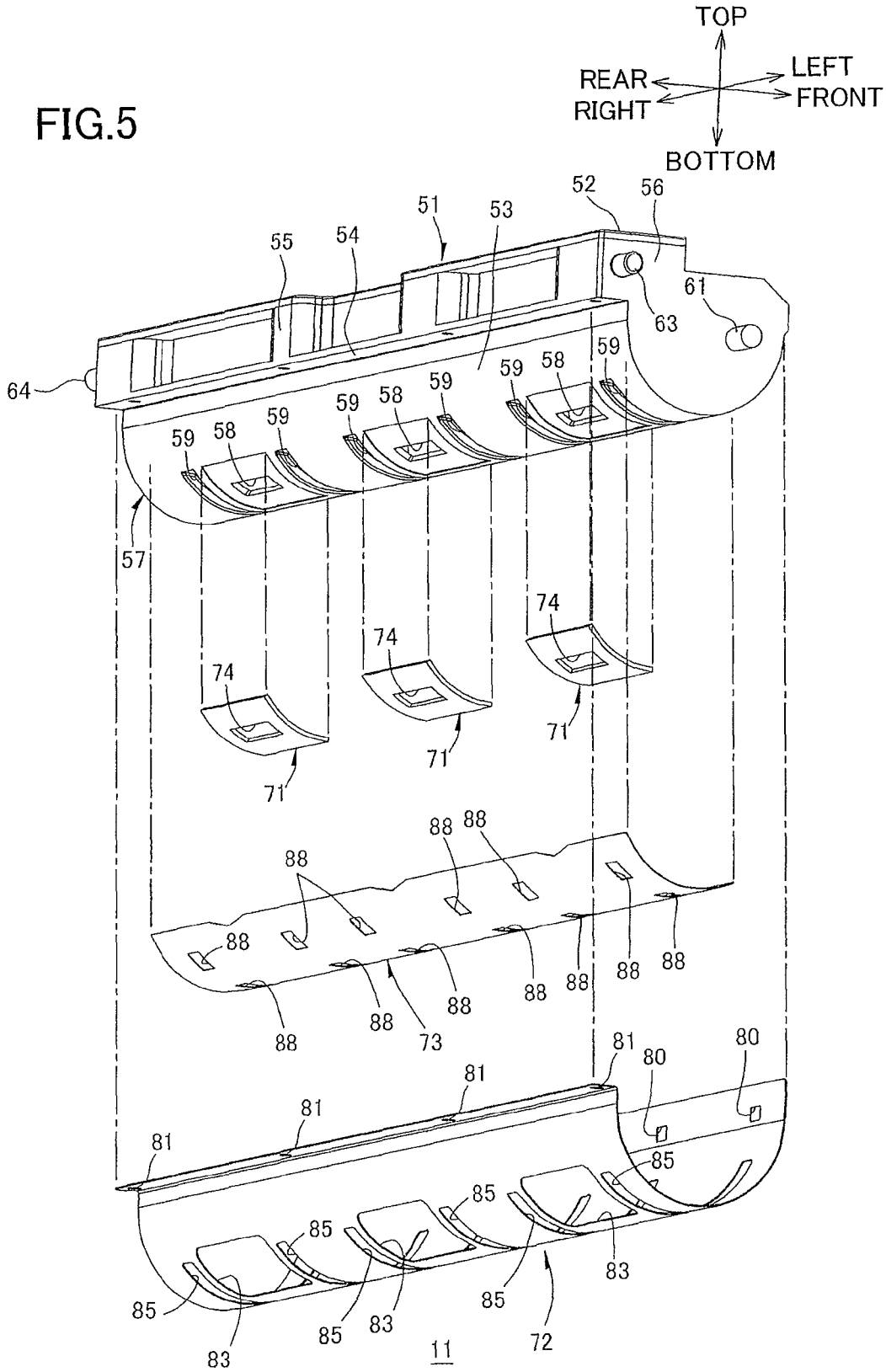
FIG. 5 is an exploded perspective view of the toner cartridge shown in FIG. 3.

As shown in FIG. 5, the toner cartridge 11 includes the casing 51 for accommodating toner. The casing 51 is formed of resin in a substantially hollow semicircular column shape and is elongated in the left-to-right direction. More specifically, the casing 51 defines an internal space for accommodating toner, and includes the top surface 52, an arcuate surface 53, a fixing surface 54, a rear surface 55, a left side surface 56, and a right side surface 57.

The top surface 52 is formed in a rectangular shape and elongated in the left-to-right direction. The arcuate surface 53 is connected to a front edge of the top surface 52 and has a substantially semicircular shape in a cross-section with a convex side facing downward. The fixing surface 54 extends parallel to the top surface 52 and protrudes rearward from a rear edge of the arcuate surface 53. The rear surface 55 bridges a rear edge of the top surface 52 and a rear edge of the fixing surface 54. The left side surface 56 bridges respective left edges of the top surface 52, the arcuate surface 53, the fixing surface 54 and the rear surface 55. The right side surface 57 bridges respective right edges of the top surface 52, the arcuate surface 53, the fixing surface 54, and the rear surface 55.

The arcuate surface 53 is formed with the three cartridge communication holes 58 at positions slightly rearward of a lowest end thereof. The cartridge communication holes 58 are rectangular in shape, elongated in the left-to-right direction, and are spaced at intervals in the left-to-right direction. The cartridge communication holes 58 provide communication between the interior and exterior of the casing 51.

Further, the arcuate surface 53 is formed with narrow slit-shaped grooves 59. The grooves 59 extend in a circumferential direction of the arcuate surface 53 and are formed one on each of left and right sides of each cartridge communication hole 58.

As shown in FIG. 3, the arcuate surface 53 has a front edge portion on which a plurality of positioning protrusions 60 is formed. The positioning protrusions 60 are spaced at intervals in the left-to-right direction. Each positioning protrusion 60 has a hook shape, extending forward, then bending and extending upward.

Figure 6A:
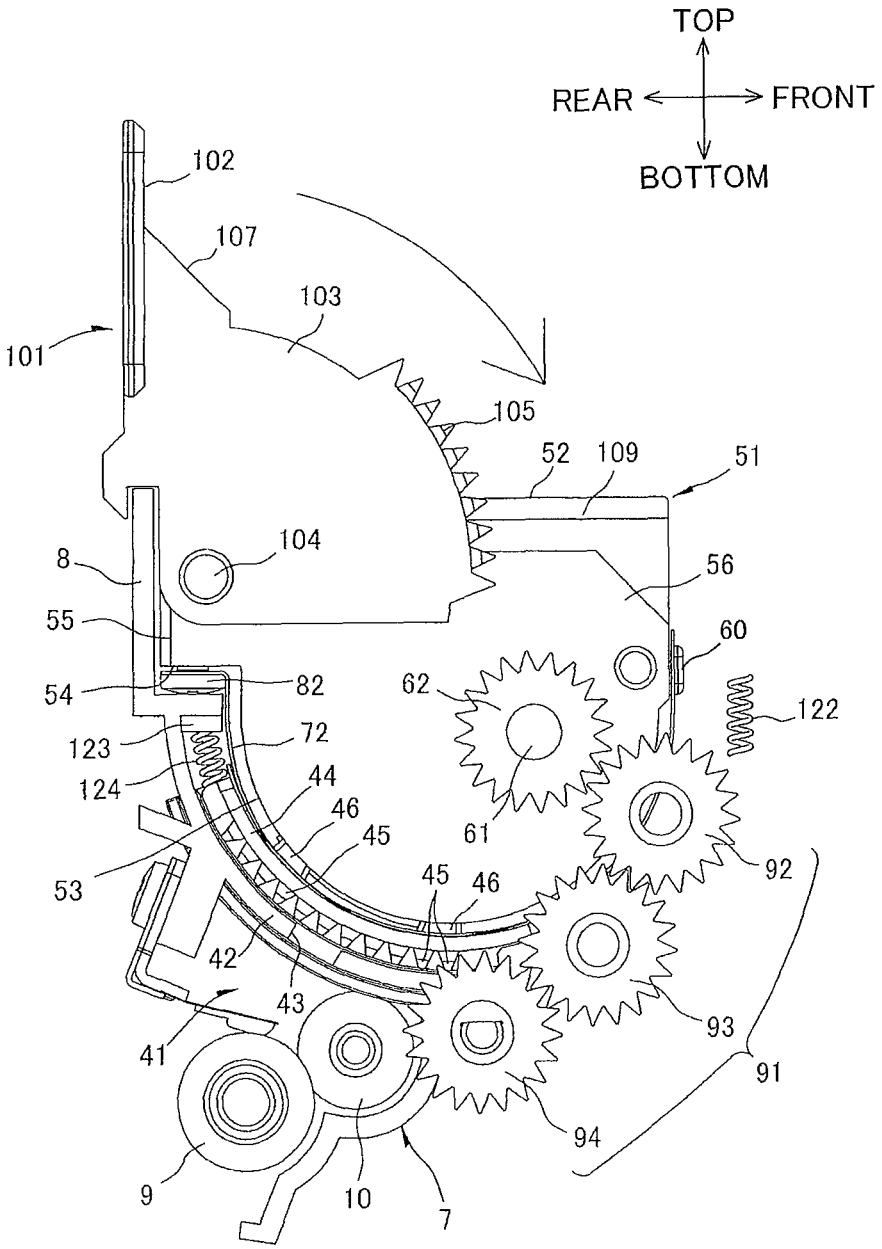
FIG. 6A is a cross-sectional view of an essential portion of the drawer unit shown in FIG. 3 and a left side view of the operation unit, wherein the operation unit is in the first posture.

As shown in FIG. 5, the left side surface 56 has a columnar shaped boss 61 protruding leftward therefrom. The boss 61 is positioned at a center of a portion surrounded by a peripheral edge of the arcuate surface 53. As shown in FIG. 6A, a driven gear 62 is rotatably supported to the boss 61. Further, the left side surface 56 has an upper rear edge portion on which a first support protrusion 63 is provided. The first support protrusion 63 is formed in a columnar shape, and protrudes leftward from the left side surface 56. Note that the driven gear 62 is omitted from FIG. 5.

A second support protrusion 64 is provided on an upper rear edge portion of the right side surface 57. The second support protrusion 64 is formed in a columnar shape, and protrudes rightward from the right side surface 57. Although it is not shown, the right side surface 57 is further provided with a columnar-shaped support protrusion that is coaxial with the boss 61 provided at the left side surface 56 (hereinafter referred to as "third support protrusion").

As shown in FIG. 5, the toner cartridge 11 further includes toner seals 71 affixed to the arcuate surface 53 of the casing 51, a shutter cover 72 disposed so as to cover the arcuate surface 53, and the shutter 73 disposed between the arcuate surface 53 and the shutter cover 72.

(2) Toner Seal

Each of the toner seals 71 is provided for each cartridge communication hole 58. The toner seal 71 has a sheet-like form and is formed with an opening 74 at a position corresponding to the cartridge communication hole 58. The toner seals 71 are fixed to the arcuate surface 53 of the casing 51 so that the openings 74 are aligned and in communication with the corresponding cartridge communication holes 58 and, hence, the toner seals 71 encircle the cartridge communication holes 58.

(3) Shutter Cover

The shutter cover 72 is curved to conform to the arcuate surface 53 of the casing 51. The shutter cover 72 is formed of a resin film. The shutter cover 72 has a width in the left-to-right direction substantially equal to a width of the arcuate surface 53 in the left-to-right direction. Thus, the shutter cover 72 covers the arcuate surface 53 across substantially the entire width in the left-to-right direction.

As shown in FIG. 5, the shutter cover 72 has a front end portion formed with a plurality of positioning openings 80 spaced apart from each other in the left-to-right direction. The positioning protrusions 60 (FIG. 3) formed on the arcuate surface 53 of the casing 51 are engaged with the positioning openings 80. More specifically, the positioning openings 80 are formed in the front end portion of the shutter cover 72 and are arrayed in the left-to-right direction corresponding to the positioning protrusions 60. Further, the positioning openings 80 are formed of a sufficient size for inserting the positioning protrusions 60. After the positioning protrusions 60 are inserted into the corresponding positioning openings 80, top edges of the positioning openings 80 engage the positioning protrusions 60.

The shutter cover 72 has a rear end portion folded back to conform to the fixing surface 54 of the casing 51. A plurality of screw insertion through-holes 81 are formed in this rear end portion of the shutter cover 72 at intervals in the left-to-right direction, as shown in FIG. 5. The shutter cover 72 is attached to the casing 51 by engaging the positioning protrusions 60 with the respective positioning openings 80, and by inserting screws 82 through all of the screw insertion through-holes 81 and screwing tips of the screws 82 into the fixing surface 54 of the casing 51.

As shown in FIG. 5, the shutter cover 72 is formed with shutter cover communication holes 83 at positions corresponding to the toner seals 71. Each of the shutter cover communication holes 83 has a rectangular shape and is elongated in the left-to-right direction. Further, the shutter cover communication hole 83 has an open area greater than that of the cartridge communication hole 58 so as to expose the cartridge communication hole 58 in its entirety.

Further, the shutter cover 72 is formed with guide slits 85 elongated in the front-to-rear direction (circumferential direction of the shutter cover 72) at positions corresponding to the grooves 59 formed in the casing 51. The guide slit 85 has a front-to-rear length greater than or equal to that of the groove 59. The guide slits 85 also has a left-to-right width greater than or equal to that of the groove 59. Each guide slit 85 confronts the corresponding groove 59 in its entirety.

(4) Shutter

As shown in FIG. 5, the shutter 73 curves along the arcuate surface 53 of the casing 51. The shutter 73 is formed of a resin film having a width in the left-to-right direction slightly smaller than that of the shutter cover 72. The shutter 73 has a dimension along the circumferential direction of the arcuate surface 53 greater than that of the toner seal 71. Further, the dimension of the shutter 73 along the circumferential direction of the arcuate surface 53 is set such that the shutter 73 does not contact the fixing surface 54 and the positioning protrusions 60 when moving between an open position and a closed position described later.

The shutter 73 is formed with two shutter drive openings 88 separated by a prescribed interval in a circumferential direction of the shutter 73 at positions opposing each groove 59 in the casing 51. The distance between the two shutter drive openings 88 in the circumferential direction is set such that all shutter drive openings 88 confront the corresponding grooves 59 and confront and communicate with the corresponding guide slits 85 formed in the shutter cover 72, regardless of whether the shutter 73 is in the open position or the closed position.

The shutter 73 is interposed between the arcuate surface 53 of the casing 51 and the shutter cover 72. While held between the arcuate surface 53 and the shutter cover 72, the shutter 73 can move between the open position and the closed position.

When the shutter 73 is in the open position, a rear edge of the shutter 73 is interposed between a front edge portion of the toner seal 71 and the shutter cover 72. Therefore, each cartridge communication hole 58 formed in the casing 51 and the opening 74 formed in the corresponding toner seal 71 are made open, while being in communication between the cartridge communication holes 58 and the shutter cover communication holes 83. This provides communication between the interior and exterior of the casing 51.

On the other hand, in the closed position, the shutter 73 is positioned farther rearward than the open position. When the shutter 73 is in the closed position, the rear edge of the shutter 73 is positioned slightly rearward from rear edges of the shutter cover communication holes 83. As a result, the shutter 73 covers the cartridge communication holes 58 formed in the casing 51 and the openings 74 formed in the toner seals 71 in their entirety, blocking communication between the interior and exterior of the casing 51. At this time, the toner seals 71 are interposed between the shutter 73 and the arcuate surface 53 of the casing 51.

4. Drive Mechanism

Within the drawer frame 31, a plurality of drive force transmission mechanisms 91 each corresponding to each shutter drive member 44 is provided. The drive force transmission mechanism 91 is adapted to transmit a rotational force generated by the driven gear 62 of the toner cartridge 11 to the rack gear 45 of the shutter drive member 44. As shown in FIG. 6A, each drive force transmission mechanism 91 includes a first transmission gear 92, a second transmission gear 93, and a third transmission gear 94. The first transmission gear 92 is meshedly engageable with the driven gear 62, when the toner cartridge 11 is in the space 12. The second transmission gear 93 is meshedly engageable with the first transmission gear 92. The third transmission gear 94 is meshedly engageable with the second transmission gear 93 and the rack gear 45. The first to third transmission gears 92, 93, 94 are rotatably supported to the left side plate 32 of the drawer frame 31.

When the driven gear 62 rotates, a rotational force is transmitted to the first transmission gear 92 from the driven gear 62, thereby rotating the first transmission gear 92. The rotational force transmitted to the first transmission gear 92 is further transmitted to the rack gear 45 through the second transmission gear 93 and the third transmission gear 94. With this configuration, the shutter drive member 44 can move in the front-to-rear direction along the partitioning wall 42, and, as described later, the shutter 73 can move between the open position and the closed position in association with the movement of the shutter drive member 44. The driven gear 62, the first transmission gear 92, the second transmission gear 93, the third transmission gear 94, and the rack gear 45 constitute a drive mechanism (gear train) for moving the shutter 73 from/to the open position to/from the closed position.

5. Urging Member

As shown in FIG. 3, the developing unit frame 8 has a block-shaped first supporting member 121. The first supporting member 121 is disposed upward and spaced apart from a front end of the shutter drive member 44 when the shutter drive member 44 is at a position corresponding to the open position of the shutter 73. The first supporting member 121 supports a first urging member 122. More specifically, the first urging member 122 has one end that is supported to the first supporting member 121, and extends downward from the first supporting member 121. The first urging member 122 is formed of a spring, for example, a coil spring. The first urging member 122 may be formed of a leaf spring plate.

Further, as shown in FIG. 4, the developing unit frame 8 has a block-shaped second supporting member 123. The second supporting member 123 is disposed upward and spaced apart from a rear end of the shutter drive member 44 when the shutter drive member 44 is at a position corresponding to the closed position of the shutter 73. More specifically, the second supporting member 123 is disposed at the partitioning wall 42. The second supporting member 123 supports a second urging member 124. More specifically, the second urging member 124 has one end that is supported to the second supporting member 123, and extends diagonally downward and frontward from the second supporting member 123. The second urging member 124 is formed of a spring, for example, a coil spring. The second urging member 124 may be formed of a leaf spring plate.

Note that the developing unit 7, the toner cartridge 11, the shutter drive member 44, the driven gear 62, the first transmission gear 92, the second transmission gear 93, the third transmission gear 94, the first urging member 122, and the second urging member 124 constitute the developing device.

6. Mounting and Dismounting of Toner Cartridge (1) Mounting of Toner Cartridge

While the drawer unit 3 (drawer frame 31) is pulled outward from the main casing 2 and disposed at the pulled-out position (FIG. 2), the toner cartridge 11 can be mounted in or dismounted from the space 12 from above. Note that mounting of the toner cartridge 11 in the space 12 implies mounting of the toner cartridge 11 relative to the developing unit 7.

When the toner cartridge 11 is not mounted in the drawer unit 3, the shutter 73 is in the closed position.

When the toner cartridge 11 is to be mounted in the space 12, as shown in FIG. 6A, the operation unit 101 corresponding to the space 12 in which the toner cartridge 11 is to be mounted is in the first posture. The first support protrusion 63 (FIG. 5) protruding from the left side surface 56 of the casing 51 is inserted into the guide groove 106 (FIG. 4) formed in the operation unit 101 from above. Further, the third support protrusion (not shown) and the second support protrusion 64 (FIG. 5) protruding from the right side surface 57 of the casing 51 are inserted into the first supporting groove 110 and the second supporting groove 111 (FIG. 2) formed in the right side plate 33 from above, respectively.

At this time, the first support protrusion 63 is moved along the front surface of the regulating member 102 and the guide surface 107, thereby being guided to the guide groove 106. In association with this movement of the first support protrusion 63, the third support protrusion (not shown) and the second support protrusion 64 are guided to the first supporting groove 110 and the second supporting groove 111, respectively. Then, the first support protrusion 63 is moved downward while being guided by the guide groove 106, and the third support protrusion (not shown) and the second support protrusion 64 are also moved downward in the first supporting groove 110 and the second supporting groove 111, respectively. When the first support protrusion 63 reaches the bottom of the guide groove 106, the third support protrusion (not shown) and the second support protrusion 64 reach the bottoms of the first supporting groove 110 and the second supporting groove 111, respectively, and thus, mounting of the toner cartridge 11 in the space 12 is completed. Hence, the toner cartridge 11 is supported to the drawer frame 31.

In this state, the shutter drive protrusions 46 are brought into engagement with the shutter drive openings 88 through the guide slits 85. Thus, engagement of the shutter 73 with the shutter drive member 44 is achieved. Further, as shown in FIG. 6A, the driven gear 62 of the toner cartridge 11 is brought into engagement with the first transmission gear 92. The gear teeth 105 of the operation unit 101 is disposed above the driven gear 62, and accordingly, not engaged with the driven gear 62. The rack gear 45 is not engaged with the third transmission gear 94, but a foremost gear tooth of the rack gear 45 is in contact with the third transmission gear 94.

Figure 6B:
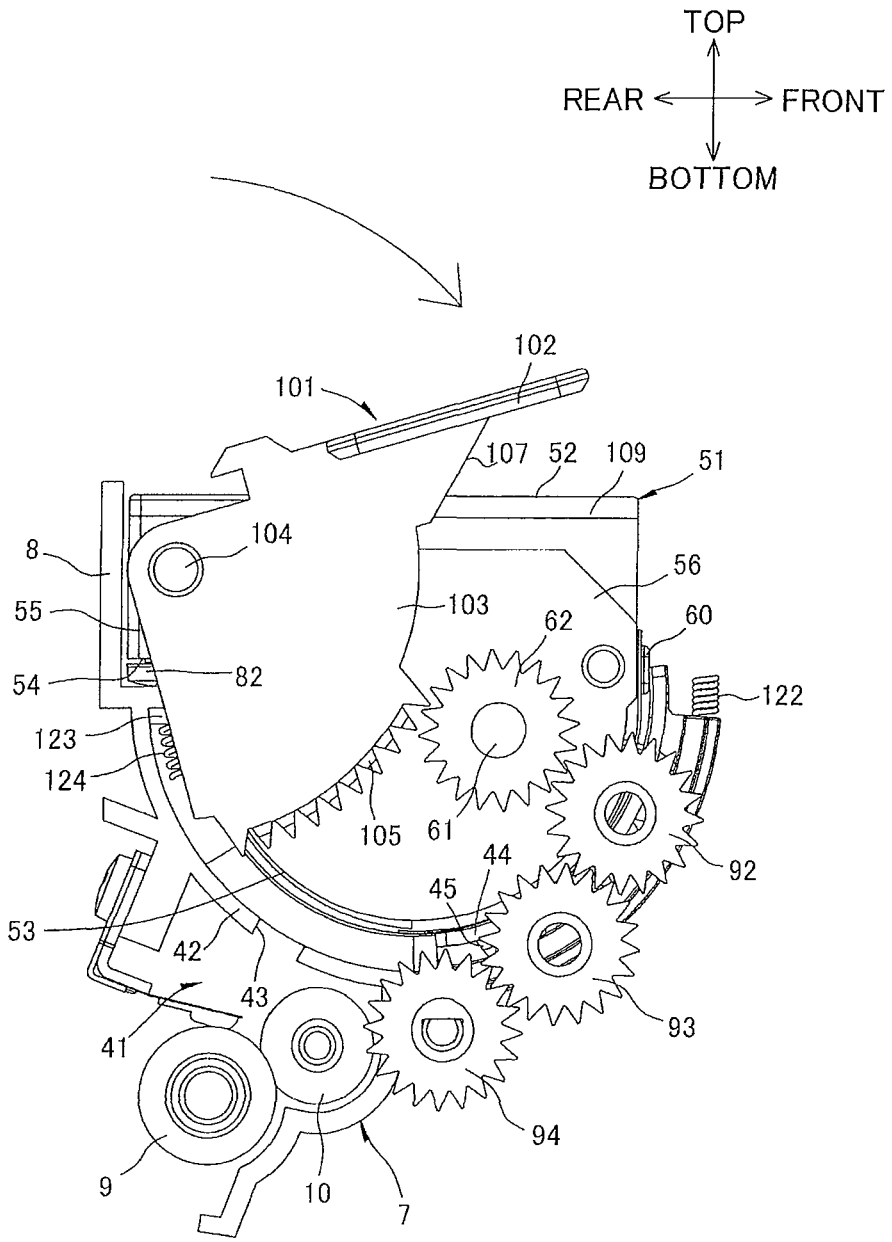
FIG. 6B is a cross-sectional view of the essential portion of the drawer unit shown in FIG. 3 and a left side view of the operation unit, wherein the operation unit is about to take the second posture.

Subsequently, the operation unit 101 is shifted to the second posture from the first posture. In association with the shift of the operation unit 101, the gear teeth 105 rotate in a clockwise direction as viewed from a left side (as indicated by an arrow shown in FIG. 6A). While rotating in the clockwise direction, the gear teeth 105 is brought into engagement with the driven gear 62 as shown in FIG. 6B. In association with rotation of the gear teeth 105 that have been engaged with the driven gear 62, the driven gear 62 rotates in a counterclockwise direction as viewed from a left side. Rotation of the driven gear 62 generates a rotational force, which is transmitted to the third transmission gear 94 through the first transmission gear 92 and the second transmission gear 93. As a result, the third transmission gear 94 rotates in the clockwise direction as viewed from a left side. In association with rotation of the third transmission gear 94, the rack gear 45 is brought into engagement with the third transmission gear 94, thereby moving the shutter drive member 44 frontward to a position not confronting the openings 43 from a position confronting the openings 43. In association with movement of the shutter drive member 44, the shutter 73 moves frontward toward the open position from the closed position together with the shutter drive member 44.

Before the shutter 73 reaches the open position but after the gear teeth 105 have been engaged with the driven gear 62, the front end of the shutter drive member 44 is brought into contact with the first urging member 122. After the shutter drive member 44 has been in contact with the first urging member 122, the shutter drive member 44 further moves forward and upward. Hence, as shown in FIG. 6B, the first urging member 122 is compressed by the front end of the shutter drive member 44. As a result, an urging force from the first urging member 122 is applied to the shutter drive member 44 in a direction such that the shutter 73 moves toward the closed position from the open position. As the shutter drive member 44 moves forward and upward to the first urging member 122, the urging force from the first urging member 122 applied to the shutter drive member 44 is gradually increased. Then, the shutter 73 moves to a position past the open position, which disengages the rack gear 45 from the third transmission gear 94. A rearmost gear tooth of the rack gear 45 is positioned forward of the third transmission gear 94.

Figure 6C:
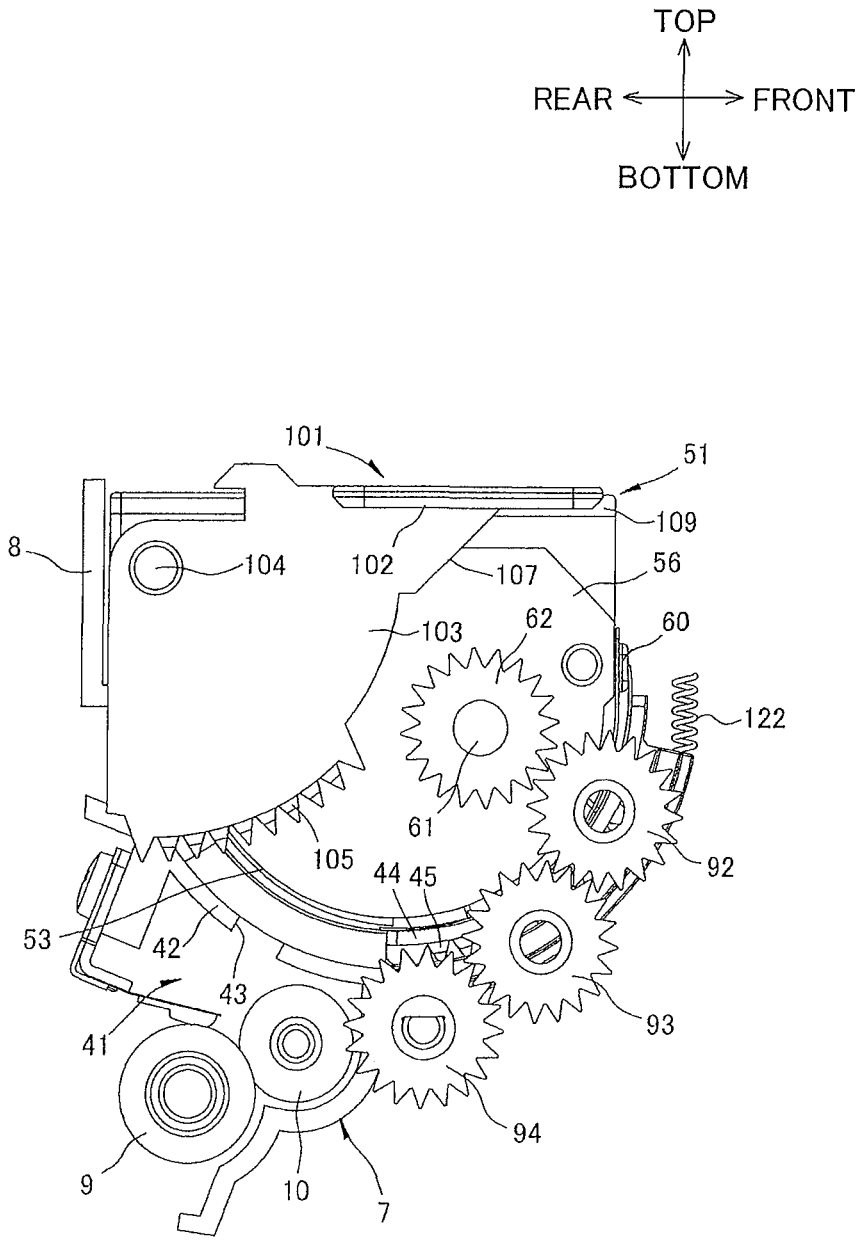
FIG. 6C is a cross-sectional view of the essential portion of the drawer unit shown in FIG. 3 and a left side view of the operation unit, wherein the operation unit is in the second posture.

When the operation unit 101 is in the second posture, the regulating member 102 is disposed above and in direct confrontation with the toner cartridge 11. Hence, the toner cartridge 11 cannot be removed from the drawer frame 31. Further, as shown in FIG. 6C, the gear teeth 105 is disengaged from the driven gear 62, and disposed rearward of the driven gear 62. Immediately before the operation unit 101 takes the second posture, the shutter 73 that has moved to a position past the open position is returned toward the open position together with the shutter drive member 44 by the urging force of the first urging member 122 applied to the shutter drive member 44. Then, when the operation unit 101 is in the second posture, the rearmost gear tooth of the rack gear 45 is brought into contact with the third transmission gear 94 from the front.

Thereafter, when the front cover 4 (FIG. 1) is moved to the closed position, an image forming operation in the color printer 1 can be started.

(2) Dismounting of Toner Cartridge

For dismounting the toner cartridge 11 from the drawer unit 3, the front cover 4 is moved to the open position, and the drawer unit 3 is moved from the accommodated position to the pulled-out position. Then, the operation unit 101 is shifted to the first posture shown in FIG. 6A from the second posture shown in FIG. 6C.

Figure 6D:
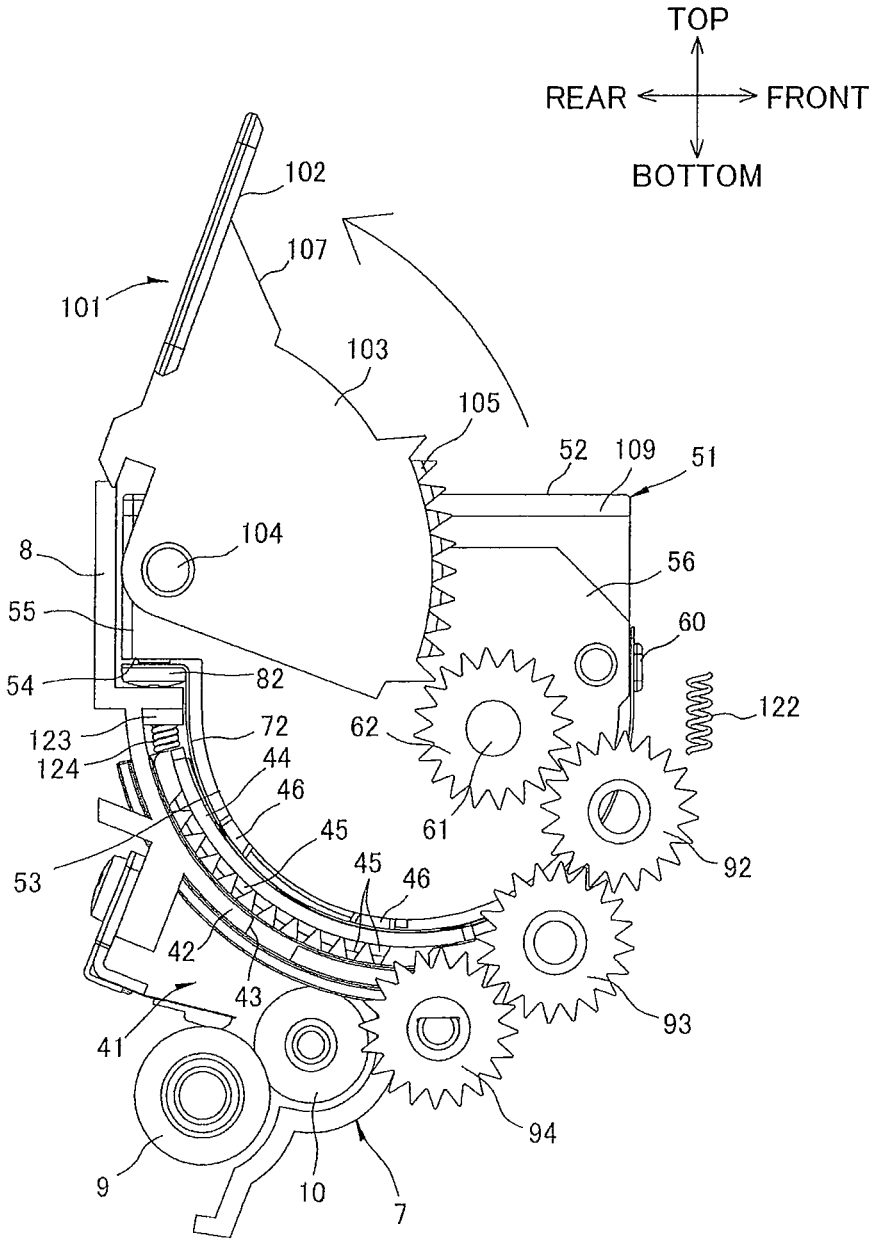
FIG. 6D is a cross-sectional view of the essential portion of the drawer unit shown in FIG. 3 and a left side view of the operation unit, wherein the operation unit is about to take the first posture.

In association with the shift of the operation unit 101, the gear teeth 105 rotates in the counterclockwise direction as viewed from a left side (as indicated by an arrow shown in FIG. 6D). While rotating in the counterclockwise direction, the gear teeth 105 is brought into engagement with the driven gear 62 as shown in FIG. 6D. In association with rotation of the gear teeth 105 that have been engaged with the driven gear 62, the driven gear 62 rotates in the clockwise direction as viewed from a left side. Rotation of the driven gear 62 generates a rotational force, which is transmitted to the third transmission gear 94 through the first transmission gear 92 and the second transmission gear 93. As a result, the third transmission gear 94 rotates in the counterclockwise direction as viewed from a left side. In association with rotation of the third transmission gear 94, the rack gear 45 is brought into engagement with the third transmission gear 94, thereby moving the shutter drive member 44 rearward to the position confronting the openings 43 from the position not confronting the openings 43. In association with movement of the shutter drive member 44, the shutter 73 moves rearward toward the closed position from the open position together with the shutter drive member 44.

Before the shutter 73 reaches the closed position but after the gear teeth 105 have been engaged with the driven gear 62, the rear end of the shutter drive member 44 is brought into contact with the second urging member 124. After the shutter drive member 44 has been in contact with the second urging member 124, the shutter drive member 44 further moves upward and rearward. Hence, as shown in FIG. 6D, the second urging member 124 is compressed by the rear end of the shutter drive member 44. As a result, an urging force from the second urging member 124 is applied to the shutter drive member 44 in a direction such that the shutter 73 moves toward the open position from the closed position. As the shutter drive member 44 moves rearward and upward to the second urging member 124, the urging force from the second urging member 124 applied to the shutter drive member 44 is gradually increased. Then, the shutter 73 moves to a position past the closed position, which disengages the rack gear 45 from the third transmission gear 94. A foremost gear tooth of the rack gear 45 is positioned rearward of the third transmission gear 94.

When the operation unit 101 is in the first posture, as shown in FIG. 6A, the gear teeth 105 is disengaged from the driven gear 62 and disposed above the driven gear 62. Immediately before the operation unit 101 takes the first posture, the shutter 73 that has moved to a position past the closed position is returned toward the closed position together with the shutter drive member 44 by the urging force of the second urging member 124 applied to the shutter drive member 44. Then, when the operation unit 101 is in the first posture, the foremost gear tooth of the rack gear 45 is brought into contact with the third transmission gear 94 from the rear.

Subsequently, the toner cartridge 11 is removed upward from the space 12. When the toner cartridge 11 has been removed from the drawer unit 3, the shutter 73 is in the closed position. Accordingly, there is no risk of toner spilling out of the casing 51 when the toner cartridge 11 is removed.

7. Operations and Effects (1) Operation and Effect 1

As described above, the toner cartridge 11 is configured to be detachable from and attachable to the developing unit 7. Further, the toner cartridge 11 includes the casing 51 defining the internal space for accommodating toner. The casing 51 is formed with the cartridge communication holes 58 for supplying toner to the developing unit 7. In order to open and close the cartridge communication holes 58, the shutter 73 is provided in the toner cartridge 11. That is, the shutter 73 is configured to be movable between the open position in which the cartridge communication holes 58 are open and the closed position in which the cartridge communication holes 58 are closed.

Further, the shutter drive member 44 is provided at the developing unit frame 8. When the toner cartridge 11 has been mounted in the developing unit 7, the shutter drive member 44 is engaged with the shutter 73. Hence, integral movement of the shutter 73 and the shutter drive member 44 can be achieved. The shutter drive member 44 is provided with the rack gear 45 extending in a moving direction of the shutter 73. When the rack gear 45 is engaged with the third transmission gear 94, a drive force from the third transmission gear 94 is transmitted to the rack gear 45. Transmission of the drive force from the third transmission gear 94 to the rack gear 45 allows the shutter 73 to move to/from the open position from/to the closed position.

When the shutter 73 is in the open position or in the closed position, the rack gear 45 is disengaged from the third transmission gear 94. Therefore, even if a drive force is unintentionally transmitted to the third transmission gear 94, such an unintentional drive force is not transmitted to the rack gear 45. Accordingly, unintentional movement of the shutter 73 to the open position or to the closed position can be avoided.

(2) Operation and Effect 2

Further, the developing unit frame 8 is provided with the first urging member 122 and the second urging member 124. When the shutter 73 is in the open position, the first urging member 122 urges the shutter drive member 44. When the shutter 73 is in the closed position, the second urging member 124 urges the shutter drive member 44. The urging force from the first urging member 122 or the second urging member 124 applied to the shutter drive member 44 brings the gear tooth of the rack gear 45 into contact with the third transmission gear 94, while the rack gear 45 is disengaged from the third transmission gear 94. Therefore, when a drive force is transmitted to the third transmission gear 94 to move the shutter 73 to the open position or to closed position, the rack gear 45 is brought into engagement with the third transmission gear 94 simultaneously with starting rotation of the third transmission gear 94. As a result, the rack gear 45 can be engaged with the third transmission gear 94 with consistent timing.

If the timing of engagement of the rack gear 45 with the third transmission gear 94 varies, the position of the shutter 73 when the third transmission gear 94 stops rotating also varies. Because the timing of engagement of the rack gear 45 with the third transmission gear 94 can be always the same, the position of the shutter 73 can be accurately controlled.

(3) Operation and Effect 3

The first urging member 122 starts urging the shutter drive member 44 while the rack gear 45 is in engagement with the third transmission gear 94 but before the shutter 73 reaches the open position. Further, the second urging member 124 starts urging the shutter drive member 44 while the rack gear 45 is in engagement with the third transmission gear 94 but before the shutter 73 reaches the closed position.

(4) Operation and Effect 4

The drawer frame 31 is provided with the drive gear portion 103 (gear teeth 105) which is engageable with the third transmission gear 94 to transmit an external drive force to the third transmission gear 94. When the shutter 73 is in the open position or in the closed position, the drive gear portion 103 is disengaged from the third transmission gear 94. Here, engagement of the drive gear portion 103 with the third transmission gear 94 implies a situation such that the drive gear portion 103 is directly engaged with the third transmission gear 94, and a situation such that the drive gear portion 103 is engaged with (connected to) the third transmission gear 94 via the driven gear 62, the first transmission gear 92, and the second transmission gear 93. Because the drive gear portion 103 is disengaged from the third transmission gear 94, an unintentional drive force from the drive gear portion 103 is not transmitted to the third transmission gear 94 when the shutter 73 is in the open position or in the closed position. Consequently, unintentional movement of the shutter 73 to the open position or to the closed position can be further prevented.

8. Modifications

Various modifications are conceivable.

(1) First Modification

Figure 7:
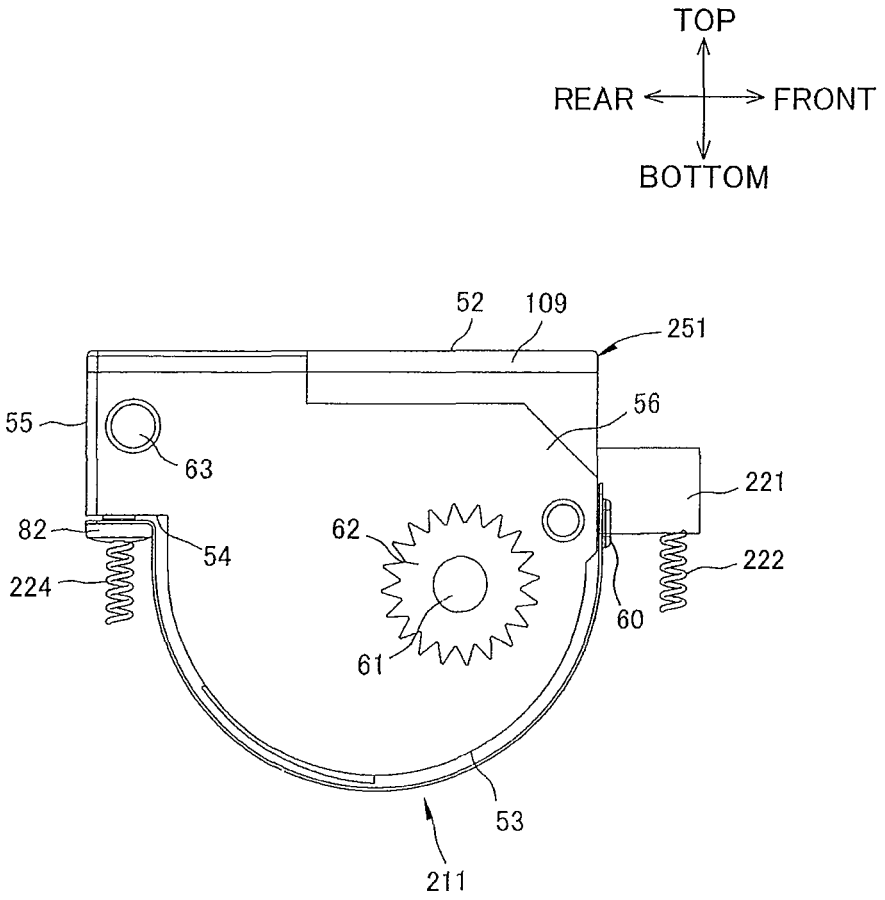
FIG. 7 is a left side view of a toner cartridge according to a first modification, wherein an urging member is provided at the toner cartridge.
Figure 8:
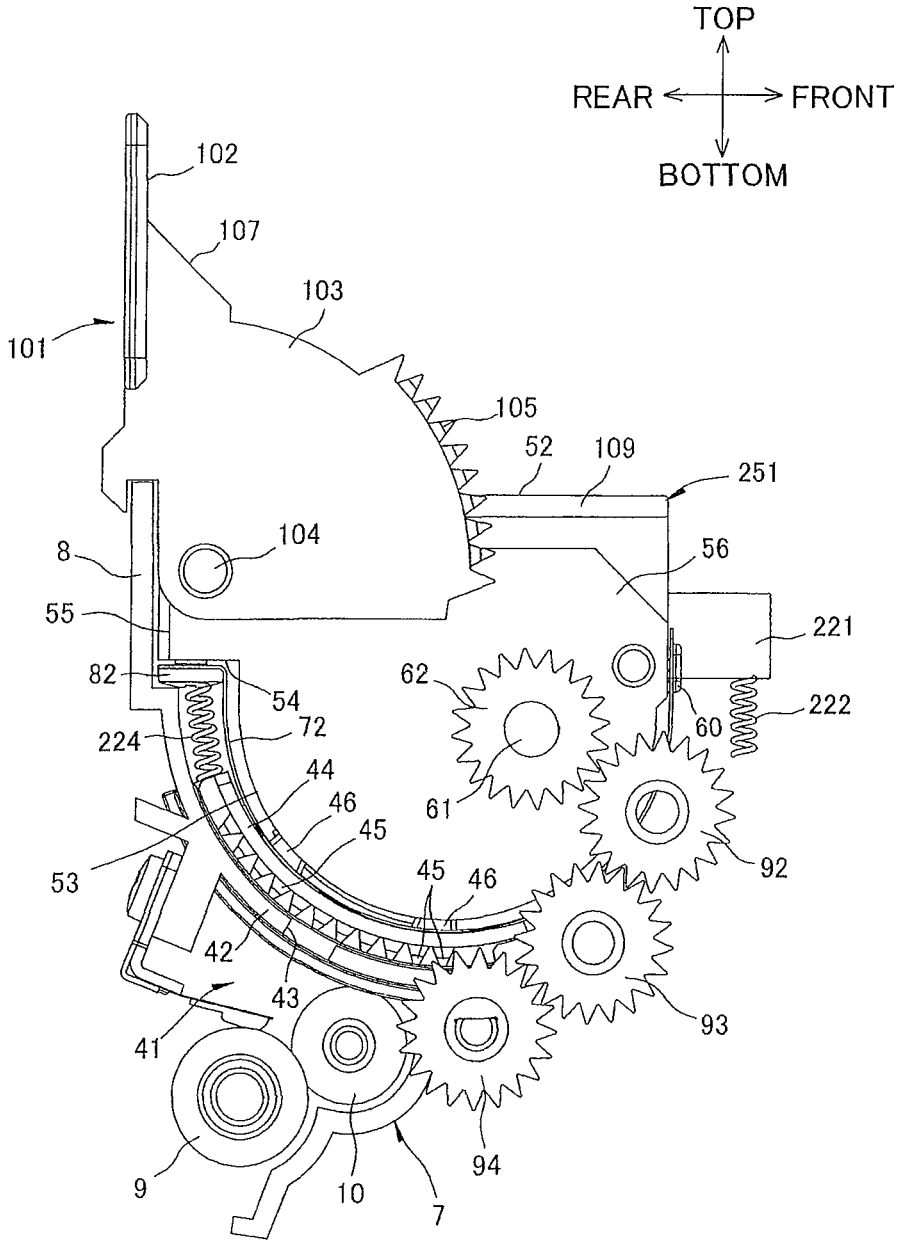
FIG. 8 is a left side view of the toner cartridge shown in FIG. 7 and a cross-sectional view of an essential portion of a drawer unit according to the first modification.

In the above-described embodiment, the first urging member 122 and the second urging member 124 are provided in the developing unit frame 8 of the developing unit 7. However, as shown in FIGS. 7 and 8, a toner cartridge 211 can be provided with a first urging member 222 and a second urging member 224, each formed of a spring, for example, a coil spring. Each of the first urging member 222 and the second urging member 224 may be formed of a leaf spring plate. More specifically, a casing 251 of the toner cartridge 211 has an arcuate surface 53 of which a front portion is formed with a first supporting member 221. An upper end of the first urging member 222 is supported to the first supporting member 221. Further, an upper end of the second urging member 224 is supported to a fixing surface 54 of the casing 51.

(2) Second Modification

Figure 9:
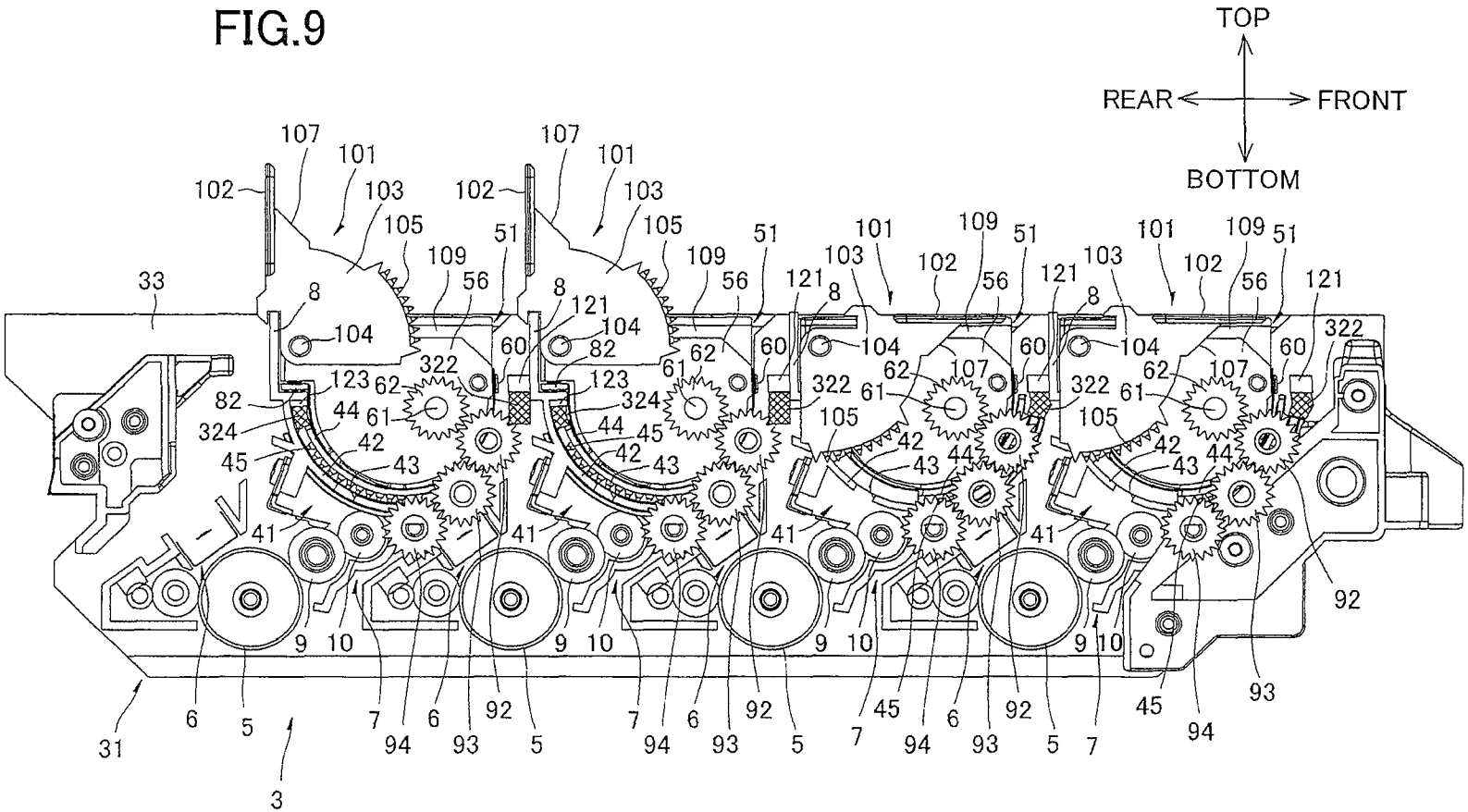
FIG. 9 is a cross-sectional view of a drawer unit according to a second modification, wherein an urging member is formed of a sponge.

In the above-described embodiment, the first urging member 122 and the second urging member 124 are formed of the coil spring. However, as shown in FIG. 9, the developing unit frame 8 is provided with a first urging member 322 and a second urging member 324 both formed of sponge having elasticity.

(3) Third Modification

Figure 10:
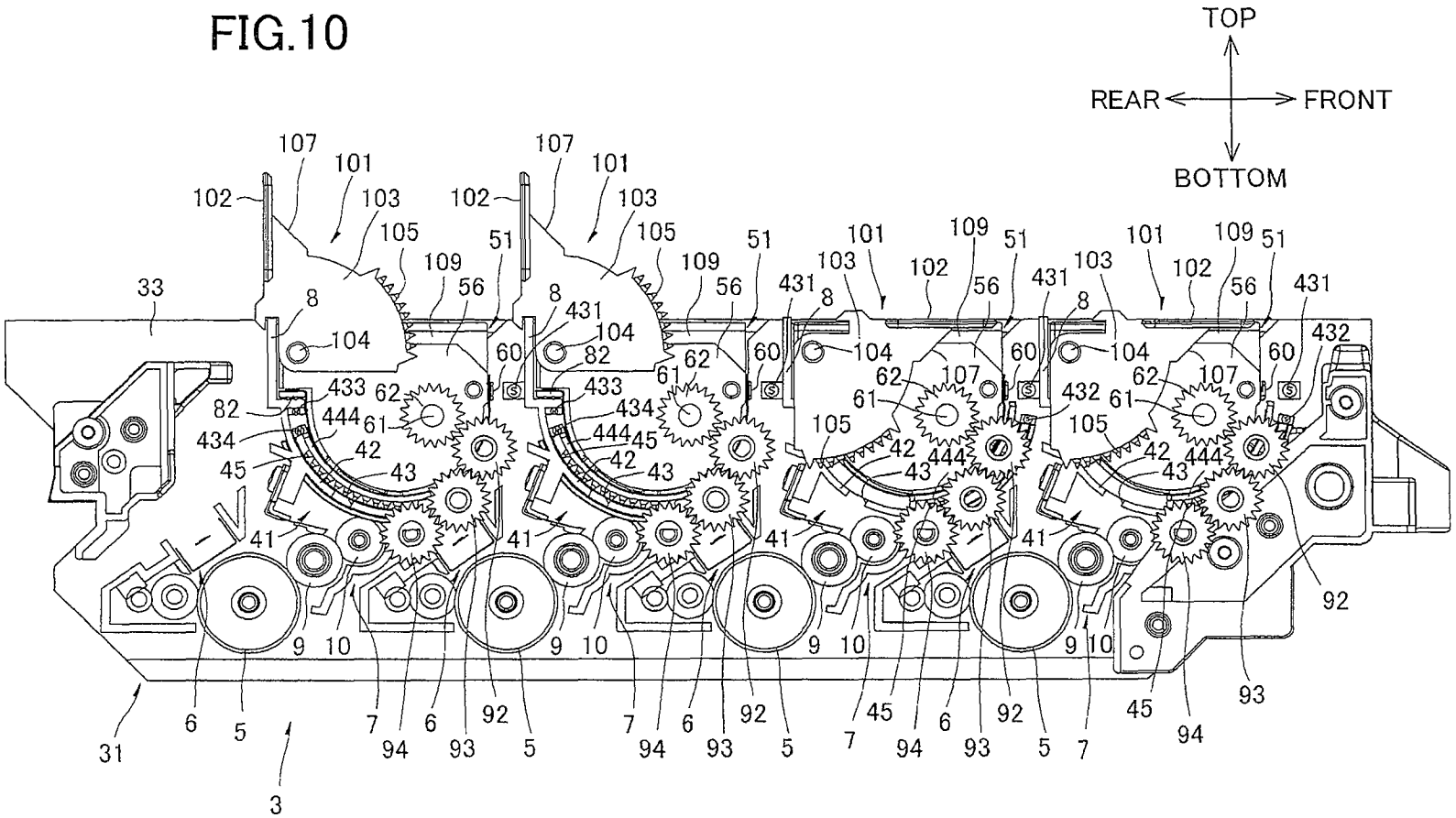
FIG. 10 is a cross-sectional view of a drawer unit according to a third modification, wherein an urging member is formed of a magnet.

As shown in FIG. 10, the developing unit frame 8 can be provided with a first magnet 431 and a third magnet 433. A front end of a shutter drive member 444 can be provided with a second magnet 432. A rear end of the shutter drive member 444 can be provided with a fourth magnet 434. A pair of the first magnet 431 and the second magnet 432 constitutes an alternative to the first urging member 122. Further, a pair of the third magnet 433 and the fourth magnet 434 constitutes an alternative to the second urging member 124. In this case, the first magnet 431 and the second magnet 432 are disposed so as to confront each other when the shutter 73 is in the open position, and each confronting portion of the first magnet 431 and the second magnet 432 has a same magnetic pole (for example, south magnetic pole). In the same manner, the third magnet 433 and the fourth magnet 434 are disposed so as to confront each other when the shutter 73 is in the closed position, and each confronting portion of the third magnet 433 and the fourth magnet 434 has a same magnetic pole (for example, north magnetic pole).

(4) Fourth Modification

In the above-described embodiment, when the shutter 73 is in the open position or in the closed position, the rack gear 45 is disengaged from the third transmission gear 94. However, it is only necessary to disengage the rack gear 45 from the third transmission gear 94 when the shutter 73 is at least either in the open position or in the closed position. By disengaging the rack gear 45 from the third transmission gear 94 when the shutter 73 is positioned at least in one of the open position and the closed position, the position of the shutter 73 can be reset to a proper position. Note that it is preferable to disengage the rack gear 45 from the third transmission gear 94 when the shutter 73 is in the open position rather than in the closed position.

(5) Fifth Modification

The present application may be applicable to any types of color printer other than the tandem-type color printer. Further, the present application may also be applicable to a monochromatic printer instead of the color printer.

While the invention has been described in detail with reference to the embodiment thereof, it would be apparent to those skilled in the art that various changes and modifications may be made therein without departing from the scope of the invention.

What is claimed is:

1. A developing device comprising:

a developing unit;

a toner cartridge mountable on or detachable from the developing unit and comprising:

a casing defining an internal space for accommodating a developing agent and formed with a communication hole for supplying the developing agent to the developing unit, and a shutter movable between an open position in which the communication hole is open and a closed position in which the communication hole is closed;

a shutter drive member including a first gear that extends in the moving direction of the shutter and that has a rotational axis extending in an axial direction, the shutter drive member being engageable with the shutter to be movable together with the shutter when the toner cartridge is mounted on the developing unit; and a second gear meshingly engageable with the first gear to transmit a drive force to the first gear, the first gear being disengaged from the second gear when the shutter is in at least one of the open position and the closed position, wherein the shutter drive member is configured to be urged in a direction intersecting the axial direction to bring the first gear that has been disengaged from the second gear into contact with the second gear.

2. The developing device as claimed in claim 1, further comprising a returning member configured to urge the shutter drive member when the shutter is in at least one of the open position and the closed position so as to bring the first gear that has been disengaged from the second gear into contact with the second gear.

3. The developing device as claimed in claim 2, wherein the returning member is configured to start urging the shutter drive member during meshing engagement of the first gear with the second gear but before the shutter reaches at least one of the open position and the closed position.

4. The developing device as claimed in claim 2, wherein the returning member is provided at the developing unit.

5. The developing device as claimed in claim 2, wherein the returning member is provided at the toner cartridge.

6. The developing device as claimed in claim 2, wherein the returning member is a spring.

7. The developing device as claimed in claim 2, wherein the returning member is a sponge.

8. The developing device as claimed in claim 2, wherein the returning member is a permanent magnet.

9. The developing device as claimed in claim 1, further comprising a sector gear meshingly engageable with the second gear to transmit an external drive force to the second gear, wherein the sector gear is disengaged from the second gear when the shutter is in the open position and in the closed position.

10. The developing device as claimed in claim 1, wherein the first gear is disengaged from the second gear at least when the shutter is in the open position.

11. The developing device as claimed in claim 10, wherein the first gear is disengaged from the second gear when the shutter is in the open position and in the closed position.

* * * * *